US009719055B2

(12) United States Patent
Eiting et al.

(10) Patent No.: US 9,719,055 B2
(45) Date of Patent: Aug. 1, 2017

(54) MACHINE DISHWASHER DETERGENT

(71) Applicant: Henkel AG & Co. KGaA, Duesseldorf (DE)

(72) Inventors: Thomas Eiting, Duesseldorf (DE); Dorota Sendor-Mueller, Moehlin (CH); Johannes Zipfel, Duesseldorf (DE); Arnd Kessler, Monheim am Rhein (DE); Thorsten Bastigkeit, Wuppertal (DE); Christian Nitsch, Duesseldorf (DE); Sven Mueller, Duisburg (DE)

(73) Assignee: Henkel AG & Co. KGaA (DE)

( * ) Notice: Subject to any disclaimer, the term of this patent is extended or adjusted under 35 U.S.C. 154(b) by 31 days.

(21) Appl. No.: 13/682,843

(22) Filed: Nov. 21, 2012

(65) Prior Publication Data

US 2013/0079268 A1 Mar. 28, 2013

Related U.S. Application Data

(63) Continuation of application No. PCT/EP2011/057180, filed on May 5, 2011.

(30) Foreign Application Priority Data

May 27, 2010 (DE) ..... 10 2010 029 348

(51) Int. Cl.

| | |
|---|---|
| ***C11D 3/00*** | (2006.01) |
| ***C11D 3/386*** | (2006.01) |
| ***C11D 17/00*** | (2006.01) |
| ***C11D 3/20*** | (2006.01) |

(52) U.S. Cl.
CPC ..... *C11D 3/38663* (2013.01); *C11D 3/2086* (2013.01)

(58) Field of Classification Search
CPC ..... C11D 3/00; C11D 3/386; C11D 17/00
USPC ..... 510/392, 393, 405; 435/263
See application file for complete search history.

(56) References Cited

U.S. PATENT DOCUMENTS

| | | | | |
|---|---|---|---|---|
| 3,634,266 | A | 1/1972 | Theile et al. | |
| 3,676,374 | A | 7/1972 | Zaki et al. | |
| 3,819,528 | A | 6/1974 | Berry | |
| 4,318,818 | A | 3/1982 | Letton et al. | |
| 5,972,873 | A * | 10/1999 | Nielsen et al. | 510/392 |
| 2002/0128588 | A1 | 9/2002 | Borgesen | |
| 2005/0261156 | A1 * | 11/2005 | Kottwitz et al. | 510/392 |
| 2006/0128588 | A1 * | 6/2006 | Lenoir | 510/392 |
| 2012/0171754 | A1 * | 7/2012 | Bessler et al. | 435/263 |

FOREIGN PATENT DOCUMENTS

| | | | |
|---|---|---|---|
| DE | 2038103 | | 2/1972 |
| DE | 102007006629 | A1 | 8/2008 |
| EP | 0342177 | A2 | 11/1989 |
| GB | 1354761 | | 5/1974 |
| JP | 2008127490 | A | 6/2008 |
| WO | 9641859 | A1 | 12/1996 |
| WO | 0208398 | A2 | 1/2002 |

OTHER PUBLICATIONS

PCT International Search Report (PCT/EP2011/057180) dated Aug. 22, 2011.

* cited by examiner

*Primary Examiner* — Gregory R DelCotto
*Assistant Examiner* — Preeti Kumar
(74) *Attorney, Agent, or Firm* — Thomas G. Krivulka

(57) ABSTRACT

A liquid cleaning agent containing: a) 20 to 70 wt % water, b) at least one amylase preparation, c) at least one $Ca^{2+}$-ion source, d) lactic acid or a lactic acid salt, is notable for elevated amylase stability and improved cleaning performance.

6 Claims, No Drawings

MACHINE DISHWASHER DETERGENT

FIELD OF THE INVENTION

The present invention generally relates to liquid cleaning agents, and more particularly relates to liquid automatic dishwashing agents, that contain amylase preparations which are stabilized with calcium lactate.

BACKGROUND OF THE INVENTION

The use of enzymes to enhance the washing and cleaning performance of washing and cleaning agents has been established in the existing art for decades. Because of their immediate cleaning action, hydrolytic enzymes in particular, such as proteases, amylases, or lipases, are a constituent of numerous textile or tableware cleaning agents.

Proteases, in particular serine proteases, among which the subtilases are also categorized according to the present invention, serve to break down protein-containing stains on the items being cleaned. Among the washing- and cleaning-agent proteases, subtilases occupy an outstanding position because of their favorable enzymatic properties such as stability or optimum pH. From the enzyme class of the amylases, the α-amylases in particular are widely used. α-Amylases (E.C. 3.2.1.1) hydrolyze internal α-1,4-glycosidic bonds of starch and starch-like polymers.

The cleaning action of the enzymes used in washing and cleaning agents, which is critical for the end user, is determined not only by the enzyme structure, but also to a substantial extent by the manner in which these enzymes are packaged, and their stabilization in terms of environmental influences.

Enzymes having washing and cleaning activity are packaged in both solid and liquid form. The group of the solid enzyme preparations includes, in particular, the enzyme granulates made up of multiple ingredients, which in turn are preferably incorporated into solid washing and cleaning agents. Liquid or gelled washing and cleaning agents, in contrast thereto, often contain liquid enzyme preparations; these, unlike the enzyme granulates, are much less protected from external influences.

A number of different protective actions have been proposed for increasing the stability of such enzyme-containing liquid washing or cleaning agents. German patent application DE 2 038 103 (Henkel), for example, teaches the stabilization of enzyme-containing dishwashing agents using saccharides, while European patent EP 646 170 B1 (Proctor & Gamble) discloses propylene glycol for enzyme stabilization in liquid cleaning agents.

Polyols, in particular glycerol and 1,2-propylene glycol, are described in the existing art as reversible protease inhibitors. A corresponding technical disclosure is found, for example, in international application WO 02/08398 A2 (Genencor).

The stabilization of enzymes in aqueous cleaning agents by means of calcium formate, calcium acetate, or calcium propionate is described by U.S. Pat. No. 4,318,818 (Procter & Gamble).

The use of lactic acid salts for enzyme stabilization is described by US patent application US 2002/128588 (Dow Chemical).

A second group of known stabilizers is constituted by borax, boric acids, boronic acids, or salts or esters thereof. Principally to be mentioned among them are derivatives having aromatic groups, for example ortho-, meta-, or para-substituted phenylboronic acids, in particular 4-formylphenylboronic acid (4-FPBA), resp. the salts or esters of the aforesaid compounds. The latter compounds are disclosed as enzyme stabilizers, for example, in international patent application WO 96/41859 A1 (Novo Nordisk). Boric acids and boric acid derivatives, for example, nevertheless often have the disadvantage that they form undesired secondary products with other ingredients of a composition, in particular washing-resp. cleaning-agent ingredients, so that they are no longer available in the relevant agents for the desired cleaning purpose, or even remain behind as contamination on the items being washed. In addition, boric acids resp. borates are considered disadvantageous from an environmental standpoint.

The methods hitherto discovered and described in the existing art for stabilizing enzymes are not usable in every cleaning-agent formulation, depending on the chemical nature of the stabilizers, and cannot always be sufficient in terms of their stabilizing action. Accordingly, it is desirable to furnish an improved stabilizing agent for enzymes, as well as an enzyme-containing cleaning agent having elevated enzyme stability. It has been found that liquid, aqueous amylase preparations can, surprisingly, be stabilized by the addition of calcium lactate.

Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

A liquid cleaning agent containing 20 to 70 wt % water, at least one amylase preparation, at least one $Ca^{2+}$-ion source, and lactic acid or a lactic acid salt.

Use of calcium lactate to stabilize amylase in liquid cleaning agents.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A first subject of this Application is a liquid cleaning agent containing a) 20 to 70 wt % water b) at least one amylase preparation c) at least one $Ca^{2}$+-ion source d) lactic acid or a lactic acid salt.

The washing- or cleaning-agent preparations according to the present invention contain at least one amylase preparation as their first essential constituent.

Examples of amylases usable according to the present invention are the ⟨-amylases from *Bacillus licheniformis*, from *B. amyloliquefaciens*, from *B. stearothermophilus*, from *Aspergillus niger* and *A. oryzae*, and the refinements of the aforesaid amylases improved for use in washing and cleaning agents. Additionally to be highlighted for this purpose are the ⟨-amylase from *Bacillus* sp. A 7-7 (DSM 12368) and the cyclodextrin-glucanotransferase (CGTase) from *B. agaradherens* (DSM 9948).

Liquid cleaning agents preferred according to the present invention contain, based on their total weight, between 0.001 and 5.0 wt %, by preference between 0.01 and 4.0 wt %, and in particular between 0.05 and 3.0 wt % amylase preparations. Cleaning agents that contain, based on their total weight, between 0.075 and 2.0 wt % amylase preparations are particularly preferred.

In addition to the amylase, the liquid cleaning agents according to the present invention can contain a further enzyme having washing or cleaning activity. The weight proportion of all enzyme preparations having washing or cleaning activity in terms of the total weight of the cleaning agent is by preference between 1.0 and 15 wt %, preferably between 1.5 and 12 wt %, particularly preferably between 2.0 and 10 wt %, and in particular between 2.5 and 8 wt %.

Proteases in particular are among the enzymes used with particular preference in this context. Among the proteases, those of the subtilisin type are preferred. Examples thereof are the subtilisins BPN' and Carlsberg and further developed forms thereof, protease PB92, subtilisins 147 and 309, the alkaline protease from *Bacillus lentus*, subtilisin DY, and the enzymes (to be classified, however, as subtilases and no longer as subtilisins in the strict sense) thermitase, proteinase K, and the proteases TW3 and TW7.

Liquid cleaning agents preferred according to the present invention contain, based on their total weight, between 0.002 and 7.0 wt %, by preference between 0.02 and 6.0 wt %, and in particular between 0.1 and 5.0 wt % protease preparations. Cleaning agents that contain, based on their total weight, between 0.2 and 4.0 wt % protease preparations are particularly preferred.

Amylases and proteases having washing or cleaning activity are furnished as a rule not in the form of the pure protein, but instead in the form of stabilized, storable and transportable preparations. Included among these prepackaged preparations are, for example, the solid preparations obtained by granulation, extrusion, or lyophilization or, in particular in the case of liquid or gelled agents, solutions of the enzymes, advantageously as concentrated as possible, low in water and/or with added stabilizers or other adjuvants.

Alternatively, the enzymes can be encapsulated for both the solid and the liquid administration form, for example by spray drying or extrusion of the enzyme solution together with a preferably natural polymer, or in the form of capsules, for example those in which the enzymes are enclosed e.g. in a solidified gel, or in those of the core-shell type, in which an enzyme-containing core is coated with a water-, air-, and/or chemical-impermeable protective layer. Further active substances, for example stabilizers, emulsifiers, pigments, bleaches, or dyes, can additionally be applied in superimposed layers. Such capsules are applied using methods known per se, for example by vibratory or roll granulation or in fluidized bed processes. Advantageously, such granulates are low in dust, for example as a result of the application of polymeric film-formers, and are shelf-stable because of the coating.

It is furthermore possible to package two or more enzymes together, so that a single granulate exhibits multiple enzyme activities.

As is apparent from the statements above, the enzyme protein constitutes only a fraction of the total weight of usual enzyme preparations. Protease and amylase preparations preferably used according to the present invention contain between 0.1 and 40 wt %, preferably between 0.2 and 30 wt %, particularly preferably between 0.4 and 20 wt %, and in particular between 0.8 and 10 wt % of the enzyme protein.

Lipases or cutinases are also usable according to the present invention, in particular because of their triglyceride-cleaving activities but also in order to generate peracids in situ from suitable precursors. Included thereamong are, for example, the lipases obtainable originally from *Humicola lanuginosa* (*Thermomyces lanuginosus*) resp. further-developed lipases, in particular those having the D96L amino acid exchange. Also usable, for example, are the cutinases that were originally isolated from *Fusarium solani pisi* and *Humicola insolens*. Lipases resp. cutinases whose starting enzymes were originally isolated from *Pseudomonas mendocina* and *Fusarium solanii* are furthermore usable.

The agents according to the present invention can contain cellulases.

Enzymes that are grouped under the term "hemicellulases" can also be used. These include, for example, mannanases, xanthanlyases, pectinlyases (=pectinases), pectinesterases, pectatelyases, xyloglucanases (=xylanases), pullulanases, and ®-glucanases.

Oxidoreductases, for example oxidases, oxygenases, catalases, peroxidases such as halo-, chloro-, bromo-, lignin, glucose, or manganese peroxidases, dioxygenases, or laccases (phenoloxidases, polyphenoloxidases), can be used according to the present invention to intensify the bleaching effect. Advantageously, preferably organic, particularly preferably aromatic compounds that interact with the enzymes are additionally added in order to enhance the activity of the relevant oxidoreductases (enhancers) or, if there is a large difference in redox potentials between the oxidizing enzymes and the stains, to ensure electron flow (mediators).

It is preferred to use multiple enzymes and/or enzyme preparations, by preference liquid protease preparations and/or amylase preparations.

A second essential constituent of the cleaning agents according to the present invention is the $Ca^{2+}$ ion source. The organic calcium salts have proven to be particularly preferred Ca-ion sources that are particularly effective with respect to stabilization of the cleaning agents. The weight proportion of the organic calcium salts in terms of the total weight of the cleaning agents according to the present invention can vary within wide limits, but those cleaning agents that contain, based on their total weight, 0.01 to 5.0 wt %, preferably 0.02 to 3.0 wt %, particularly preferably 0.05 to 2.0 wt %, and in particular 0.01 to 1.0 wt % $Ca^{2+}$ ions from calcium salts have proven to be particularly stable.

A further essential constituent of cleaning agents according to the present invention is lactic acid resp. a lactic acid salt. Preferred lactic acid salts are the salts of the alkali and alkaline earth metals. The weight proportion of the lactic acid resp. lactic acid salt in terms of the total weight of the cleaning agent is by preference 0.05 to 10 wt %, preferably 0.1 to 8.0 wt %, particularly preferably 0.2 to 5.0 wt %, and in particular 0.25 to 2.5 wt %.

It is particularly preferred to use calcium lactate as a shared source of Ca2+ ions and lactic acid. Liquid cleaning agents wherein the liquid cleaning agent contains calcium lactate, the weight proportion of the calcium lactate in terms of the total weight of the cleaning agent being by preference 0.05 to 10 wt %, preferably 0.1 to 8.0 wt %, particularly preferably 0.2 to 5.0 wt %, and in particular 0.25 to 2.5 wt %, are therefore preferred according to the present invention.

A preferred subject of this Application is a liquid cleaning agent containing a) 20 to 70 wt % water b) at least one amylase preparation c) calcium lactate.

The composition of some further preferred cleaning agents according to the present invention may be gathered from the tables below (indications in wt %):

TABLE 1

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Ca ion source | 0.05 to 10 | 0.1 to 8.0 | 0.2 to 5.0 | 0.25 to 2.5 |
| Lactic acid (salt) | 0.05 to 10 | 0.1 to 8.0 | 0.2 to 5.0 | 0.25 to 2.5 |
| Water | 20 to 70 | 20 to 70 | 20 to 70 | 20 to 70 |
| misc. | to 100 | to 100 | to 100 | to 100 |

TABLE 2

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Calcium lactate | 0.05 to 10 | 0.1 to 8.0 | 0.2 to 5.0 | 0.25 to 2.5 |
| Water | 20 to 70 | 20 to 70 | 20 to 70 | 20 to 70 |
| misc. | to 100 | to 100 | to 100 | to 100 |

The cleaning agents according to the present invention contain an organic solvent as a constituent that is preferred in terms of the stability of the enzyme preparations. Preferred organic solvents derive from the group of the monovalent or polyvalent alcohols, alkanolamines, or glycol ethers. The solvents are by preference selected from ethanol, n-propanol or isopropanol, butanol, glycol, propanediol or butanediol, glycerol, diglycol, propyl or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, or propylene glycol propyl ether, dipropylene glycol methyl ether or dipropylene glycol ethyl ether, methoxy-, ethoxy-, or butoxytriglycol, 1-butoxyethoxy-2-propanol, 3-methyl-3-methoxybutanol, propylene glycol t-butyl ether, and mixtures of these solvents. The weight proportion of these organic solvents in terms of the total weight of cleaning-agent preparations according to the present invention is by preference 0.1 to 10 wt %, preferably 0.2 to 8.0 wt %, and in particular 0.5 to 5.0 wt %.

An organic solvent that is particularly preferred and is particularly effective with respect to stabilization of the cleaning agents is glycerol, as well as 1,2-propylene glycol.

Liquid cleaning agents that contain at least one polyol, by preference from the group of glycerol and 1,2-propylene glycol, the weight proportion of the polyol in terms of the total weight of the cleaning agent being by preference 0.1 and 10 wt %, preferably 0.2 and 8.0 wt %, and in particular 0.5 and 5.0 wt %, are preferred according to the present invention.

A second preferred constituent of the cleaning agents according to the present invention is a sugar alcohol (alditol). The group of the alditols encompasses non-cyclic polyols of the formula $HOCH_2[CH(OH)]_nCH_2OH$. Included among the alditols are, for example, mannitol, isomalt, lactitol, sorbitol and xylitol, threitol, erythritol, and arabitol. Sorbitol has proven particularly advantageous in terms of enzyme stability. The weight proportion of the sugar alcohol in terms of the total weight of the automatic dishwashing agent is by preference 1.0 to 10 wt %, preferably 2.0 to 8.0 wt %, and in particular 3.0 to 6.0 wt %.

Liquid cleaning agents that contain at least one alditol, by preference sorbitol, the weight proportion of the alditol in terms of the total weight of the cleaning agent being by preference 1.0 to 10 wt %, preferably 2.0 to 8.0 wt %, and in particular 3.0 to 6.0 wt %, are preferred according to the present invention.

A third preferred constituent of the cleaning agent according to the present invention is boric acid resp. a boric acid derivative. Besides boric acid, by preference the boronic acids or salts or esters thereof are used in particular, among them chiefly derivatives having aromatic groups, for example ortho-, meta- or para-substituted phenylboronic acids, in particular 4-formylphenylboronic acid (4-FPBA), resp. the salts or esters of the aforesaid compounds. A particularly preferred boric acid derivative and one that is particularly effective with regard to stabilization of the washing- or cleaning-agent preparation is 4-formylphenylboronic acid. Preferred cleaning agents according to the present invention are therefore characterized in that the cleaning agent encompasses a phenylboronic acid derivative having the structural formula

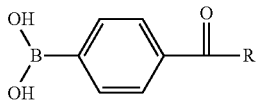

in which R denotes hydrogen, a hydroxyl, a $C_1$ to $C_6$ alkyl, a substituted $C_1$ to $C_6$ alkyl, a $C_1$ to $C_6$ alkenyl, or a substituted $C_1$ to $C_6$ alkenyl group, 4-formylphenylboronic acid being particularly preferred, and the weight proportion of the phenylboronic acid derivative in terms of the total weight of the cleaning agent being by preference 0.001 to 2 wt %, preferably 0.01 to 1.5 wt %, and in particular 0.1 to 1 wt %.

The liquid cleaning agents can contain further substances having washing or cleaning activity besides the ingredients described previously, substances from the group of the surfactants, builders, polymers, glass corrosion inhibitors, corrosion inhibitors, scents, and perfume carriers being preferred. These preferred ingredients are described in more detail below.

The composition of some further preferred cleaning agents according to the present invention may be gathered from the tables below (indications in wt %):

TABLE 3

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Ca ion source | 0.05 to 10 | 0.1 to 8.0 | 0.2 to 5.0 | 0.25 to 2.5 |
| Lactic acid (salt) | 0.05 to 10 | 0.1 to 8.0 | 0.2 to 5.0 | 0.25 to 2.5 |
| Sorbitol | 1.0 to 10 | 2.0 to 8.0 | 2.0 to 8.0 | 3.0 to 6.0 |
| Water | 20 to 70 | 20 to 70 | 20 to 70 | 20 to 70 |
| misc. | to 100 | to 100 | to 100 | to 100 |

TABLE 4

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Ca ion source | 0.05 to 10 | 0.1 to 8.0 | 0.2 to 5.0 | 0.25 to 2.5 |
| Lactic acid (salt) | 0.05 to 10 | 0.1 to 8.0 | 0.2 to 5.0 | 0.25 to 2.5 |

TABLE 4-continued

| | Formulation 1 | Formulation 2 | Formulation 3 | Formulation 4 |
|---|---|---|---|---|
| 4-formylphenyl-boronic acid | 0.001 to 2.0 | 0.01 to 1.5 | 0.01 to 1.5 | 0.01 to 1.0 |
| Water | 20 to 70 | 20 to 70 | 20 to 70 | 20 to 70 |
| misc. | to 100 | to 100 | to 100 | to 100 |

TABLE 5

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Calcium lactate | 0.05 to 10 | 0.1 to 8.0 | 0.2 to 5.0 | 0.25 to 2.5 |
| Sorbitol | 1.0 to 10 | 2.0 to 8.0 | 2.0 to 8.0 | 3.0 to 6.0 |
| 4-formyl-phenylboronic acid | 0.001 to 2.0 | 0.01 to 1.5 | 0.01 to 1.5 | 0.01 to 1.0 |
| Water | 20 to 70 | 20 to 70 | 20 to 70 | 20 to 70 |
| misc. | to 100 | to 100 | to 100 | to 100 |

A preferred constituent of the cleaning agents according to the present invention is nonionic surfactants, nonionic surfactants of the general formula $R^1$—CH(OH)$CH_2$O-$(AO)_w$-$(A'O)_x$-$(A''O)_y$-$(A'''O)_z$—$R^2$, in which

- $R^1$ denotes a straight-chain or branched, saturated or mono- or polyunsaturated $C_{6-24}$ alkyl or alkenyl residue;
- $R^2$ denotes a linear or branched hydrocarbon residue having 2 to 26 carbon atoms;
- A, A', A'', and A''', mutually independently, denote a residue from the group —$CH_2CH_2$, —$CH_2CH_2$—$CH_2$, —$CH_2$—CH($CH_3$), —$CH_2$—$CH_2$—$CH_2$—$CH_2$, —$CH_2$—CH($CH_3$)—$CH_2$—, —$CH_2$—CH($CH_2$—$CH_3$),
- w, x, y, and z denote values between 0.5 and 120, such that x, y, and/or z can also be 0 being preferred.

As a result of the addition of the aforesaid nonionic surfactants of the general formula $R^1$—CH(OH)$CH_2$O-$(AO)_w$-$(A'O)_x$-$(A''O)_y$-$(A'''O)_z R^2$, hereinafter also referred to as "hydroxy mixed ethers," it is possible, surprisingly, to considerably improve the cleaning performance of enzyme-containing preparations according to the present invention, both in comparison with a surfactant-free system and in comparison with systems that contain alternative nonionic surfactants, for example from the group of the polyalkoxylated fatty alcohols.

The stability of the enzymes contained in the washing- or cleaning-agent preparations according to the present invention can be considerably improved by the use of these nonionic surfactants having one or more free hydroxyl groups on one or both terminal alkyl residues.

Those end-capped poly(oxyalkylated) nonionic surfactants that, in accordance with the formula $R^1O[CH_2CH_2O]_x CH_2CH(OH)R^2$, besides a residue $R^1$ that denotes linear or branched, saturated or unsaturated, aliphatic or aromatic hydrocarbon residues having 2 to 30 carbon atoms, by preference having 4 to 22 carbon atoms, additionally contain a linear or branched, saturated or unsaturated, aliphatic or aromatic hydrocarbon residue $R^2$ having 1 to 30 carbon atoms, where x denotes values between 1 and 90, by preference values between 30 and 80, and in particular values between 30 and 60, are particularly preferred.

Surfactants of the formula $R^1O[CH_2CH(CH_3)O]_x [CH_2CH_2O]_y CH_2CH(OH)R^2$, in which $R^1$ denotes a linear or branched aliphatic hydrocarbon residue having 4 to 18 carbon atoms or mixtures thereof, $R^2$ denotes a linear or branched hydrocarbon residue having 2 to 26 carbon atoms or mixtures thereof, and x denotes values between 0.5 and 1.5 and y denotes a value of at least 15, are particularly preferred.

The group of these nonionic surfactants includes, for example, the $C_{2-26}$ fatty alcohol-$(PO)_1$-$(EO)_{15-40}$-2-hydroxyalkyl ethers, in particular also the $C_{8-10}$ fatty alcohol-$(PO)_1$-$(EO)_{22}$-2-hydroxydecyl ethers.

Also particularly preferred are those end-capped poly(oxyalkylated) nonionic surfactants of the formula $R^1O [CH_2CH_2O]_x[CH_2CH(R^3)O]_y CH_2CH (OH)R^2$ in which $R^1$ and $R^2$, mutually independently, denote a linear or branched, saturated or mono-resp. polyunsaturated hydrocarbon residue having 2 to 26 carbon atoms, $R^3$ is selected, mutually independently, from —$CH_3$, —$CH_2CH_3$, —$CH_3CH_2$—$CH_3$, —$CH(CH_3)_2$, but by preference denotes —$CH_3$, and x and y, mutually independently, denote values between 1 and 32, nonionic surfactants where $R^3$=—$CH_3$ and having values for x from 15 to 32, and for y from 0.5 to 1.5, being very particularly preferred.

Further nonionic surfactants usable in preferred fashion are the end-capped poly(oxyalkylated) nonionic surfactants of the formula $R^1O[CH_2CH(R^3)O]_x[CH_2]_k CH(OH)[CH_2]_j OR^2$ in which $R^1$ and $R^2$ denote linear or branched, saturated or unsaturated, aliphatic or aromatic hydrocarbon residues having 1 to 30 carbon atoms; $R^3$ denotes H or a methyl, ethyl, n-propyl, isopropyl, n-butyl, 2-butyl, or 2-methyl-2-butyl residue; x denotes values between 1 and 30; and k and j denote values between 1 and 12, by preference between 1 and 5. If the value of x is greater than Or equal to 2, each $R^3$ in the above formula $R^1O[CH_2CH(R^3)O]_x[CH_2]_k CH(OH) [CH_j]OR^2$ can be different. $R^1$ and $R^2$ are by preference linear or branched, saturated or unsaturated, aliphatic or aromatic hydrocarbon residues having 6 to 22 carbon atoms, residues having 8 to 18 carbon atoms being particularly preferred. For the $R^3$ residue, H, —$CH_3$, or —$CH_2CH_3$ are particularly preferred. Particularly preferred values for x are in the range from 1 to 20, in particular from 6 to 15.

As described above, each $R^3$ in the formula above can be different if x≥2. The alkylene oxide unit within square brackets can thereby be varied. If, for example, x denotes 3, the $R^3$ residue can be selected so as to form ethylene oxide units ($R^3$=H) or propylene oxide units ($R^3$=$CH_3$), which can be joined onto one another in any sequence, for example (EO)(PO)(EO), (EO)(EO)(PO), (EO)(EO)(EO), (PO)(EO)(PO), (PO)(PO)(EO), and (PO)(PO)(PO). The value of 3 for x was selected here as an example, and can certainly be larger; the range of variation increases with rising values of x and includes, for example, a large number of (EO) groups combined with a small number of (PO) groups, or vice versa.

Particularly preferred end-capped poly(oxyalkylated) alcohols of the above formula have values of k=1 and j=1, so that the formula above is simplified to $R^1O[CH_2CH(R^3)O]_x CH_2CH(OH)CH_2OR^2$. In the latter formula, $R^1$, $R^2$, and $R^3$ are as defined above, and x denotes numbers from 1 to 30, by preference from 1 to 20, and in particular from 6 to 18. Surfactants in which the $R^1$ and $R^2$ residues have 9 to 14 carbon atoms, $R^3$ denotes H, and x assumes values from 6 to 15, are particularly preferred.

Lastly, the nonionic surfactants of the general formula $R^1$—CH(OH)$CH_2$O-$(AO)_w$—$R^2$ in which $R^1$ denotes a straight-chain or branched, saturated or mono-resp. polyunsaturated $C_{6-24}$ alkyl or alkenyl residue;

$R^2$ denotes a linear or branched hydrocarbon residue having 2 to 26 carbon atoms;

A denotes a residue from the group $CH_2CH_2$, $CH_2CH_2$—$CH_2$, —$CH_2$—$CH(CH_3)$; and w denotes values between 1 and 120, by preference 10 to 80, in particular 20 to 40 have proven particularly effective.

The group of these nonionic surfactants includes, for example, the $C_{4-22}$ fatty alcohol-$(EO)_{10-80}$-2-hydroxyalkyl ethers, in particular also the $C_{8-12}$ fatty alcohol-$(EO)_{22}$-2-hydroxydecyl ethers and the $C_{4-22}$ fatty alcohol-$(EO)_{40-80}$-2-hydroxyalkyl ethers.

Preferred liquid cleaning agents are characterized in that the cleaning agent contains at least one nonionic surfactant, by preference a nonionic surfactant from the group of the hydroxy mixed ethers, the weight proportion of the nonionic surfactant in terms of the total weight of the cleaning agent being by preference 0.5 to 10 wt %, preferably 1.0 to 8.0 wt %, and in particular 2.0 to 6.0 wt %.

Preferred automatic dishwashing agents according to the present invention can contain further surfactants, in particular amphoteric surfactants, besides the above-described nonionic surfactants. The proportion of anionic surfactants in terms of the total weight of the cleaning agents is, however, preferably limited. Preferred liquid cleaning agents are therefore characterized in that the cleaning agent contains, based on its total weight, less than 5.0 wt %, by preference less than 3.0 wt %, particularly preferably less than 1.0 wt %, and in particular no anionic surfactant. The use of anionic surfactants is omitted in this context in particular in order to avoid excessive foaming.

TABLE 6

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Ca ion source | 0.05 to 10 | 0.1 to 8.0 | 0.2 to 5.0 | 0.25 to 2.5 |
| Lactic acid (salt) | 0.05 to 10 | 0.1 to 8.0 | 0.2 to 5.0 | 0.25 to 2.5 |
| Hydroxy mixed ethers | 0.5 to 10 | 1.0 to 8.0 | 1.0 to 8.0 | 2.0 to 6.0 |
| Water misc. | 20 to 70 to 100 | 20 to 70 to 100 | 20 to 70 to 100 | 20 to 70 to 100 |

TABLE 7

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Ca ion source | 0.05 to 10 | 0.1 to 8.0 | 0.2 to 5.0 | 0.25 to 2.5 |
| Lactic acid (salt) | 0.05 to 10 | 0.1 to 8.0 | 0.2 to 5.0 | 0.25 to 2.5 |
| Hydroxy mixed ethers | 0.5 to 10 | 1.0 to 8.0 | 1.0 to 8.0 | 2.0 to 6.0 |
| Anionic surfactant | <5.0 | <3.0 | <1.0 | <1.0 |
| Water misc. | 20 to 70 to 100 | 20 to 70 to 100 | 20 to 70 to 100 | 20 to 70 to 100 |

TABLE 8

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Calcium lactate | 0.05 to 10 | 0.1 to 8.0 | 0.2 to 5.0 | 0.25 to 2.5 |
| 4-formyl-phenylboronic acid | 0.001 to 2.0 | 0.01 to 1.5 | 0.01 to 1.5 | 0.01 to 1.0 |
| Hydroxy mixed ethers | 0.5 to 10 | 1.0 to 8.0 | 1.0 to 8.0 | 2.0 to 6.0 |
| Anionic surfactant | <5.0 | <3.0 | <1.0 | <1.0 |
| Water misc. | 20 to 70 to 100 | 20 to 70 to 100 | 20 to 70 to 100 | 20 to 70 to 100 |

TABLE 9

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Calcium lactate | 0.05 to 10 | 0.1 to 8.0 | 0.2 to 5.0 | 0.25 to 2.5 |
| Sorbitol | 1.0 to 10 | 2.0 to 8.0 | 2.0 to 8.0 | 3.0 to 6.0 |
| 4-formyl-phenyl-boronic acid | 0.001 to 2.0 | 0.01 to 1.5 | 0.01 to 1.5 | 0.01 to 1.0 |
| Hydroxy mixed ethers | 0.5 to 10 | 1.0 to 8.0 | 1.0 to 8.0 | 2.0 to 6.0 |
| Anionic surfactant | <5.0 | <3.0 | <1.0 | <1.0 |
| Water misc. | 20 to 70 to 100 | 20 to 70 to 100 | 20 to 70 to 100 | 20 to 70 to 100 |

A further preferred constituent of cleaning agents according to the present invention is complexing agents. The phosphonates are particularly preferred complexing agents. The complexing phosphonates encompass, besides 1-hydroxyethane-1,1-diphosphonic acid, a number of different compounds such as, for example, diethylenetriaminepenta (methylenephosphonic acid) (DTPMP). Hydroxyalkane- resp. aminoalkanephosphonates are preferred in this Application. Among the hydroxyalkanephosphonates, 1-hydroxyethane-1,1-diphosphonate (HEDP) is of particular importance as a co-builder. It is used by preference as a sodium salt, the disodium salt reacting neutrally and the tetrasodium salt in alkaline fashion (pH 9). Suitable aminoalkanephosphonates are, by preference, ethylenediaminetetramethylenephosphonate (EDTMP), diethylenetriaminepentamethylenephosphonate (DTPMP), as well as higher homologs thereof. They are used by preference in the form of the neutrally reacting sodium salts, e.g. as a hexasodium salt of EDTMP resp. as a hepta- and octasodium salt of DTPMP. Of the class of the phosphonates, HEDP is preferably used as a builder. The aminoalkanephosphonates moreover possess a pronounced ability to bind heavy metals. It may accordingly be preferred, in particular if the agents also contain bleaches, to use aminoalkanephosphonates, in particular DTPMP, or mixtures of the aforesaid phosphonates.

A washing- or cleaning-agent composition A preferred in the context of this Application contains one or more phosphonate(s) from the group of a) aminotrimethylenephosphonic acid (ATMP) and/or salts thereof, b) ethylenediaminetetra(methylenephosphonic acid) (EDTMP) and/or salts thereof, c) diethylenetriaminepenta(methylenephosphonic acid) (DTPMP) and/or salts thereof, d) 1-hydroxyethane-1,1-diphosphonic acid (HEDP) and/or salts thereof, e) 2-phosphonobutane-1,2,4-tricarboxylic acid (PBTC) and/or salts thereof, f) hexamethylenediaminetetra(methylenephosphonic acid) (HDTMP) and/or salts thereof, g) nitrilotri(methylenephosphonic acid) (NTMP) and/or salts thereof.

Washing- or cleaning-agent preparations A that contain 1-hydroxyethane-1,1-diphosphonic acid (HEDP) or diethylenetriaminepenta(methylenephosphonic acid) (DTPMP) as phosphonates are particularly preferred.

The cleaning agents according to the present invention can of course contain two or more different phosphonates.

Preferred cleaning agents according to the present invention are characterized in that the cleaning agent contains at least one complexing agent from the group of the phosphonates, by preference 1-hydroxyethane-1,1-diphosphonate, the weight proportion of the phosphonate in terms of the total weight of the cleaning agent being by preference 0.1 and 8.0 wt %, preferably 0.2 and 5.0 wt %, and in particular 0.5 and 3.0 wt %.

TABLE 12

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Calcium lactate | 0.05 to 10 | 0.1 to 8.0 | 0.2 to 5.0 | 0.25 to 2.5 |
| Sorbitol | 1.0 to 10 | 2.0 to 8.0 | 2.0 to 8.0 | 3.0 to 6.0 |
| 4-formyl-phenyl-boronic acid | 0.001 to 2.0 | 0.01 to 1.5 | 0.01 to 1.5 | 0.01 to 1.0 |
| Phosphonate | 0.1 to 8.0 | 0.1 to 8.0 | 0.2 to 5.0 | 0.5 to 3.0 |
| Water | 20 to 70 | 20 to 70 | 20 to 70 | 20 to 70 |
| misc. | to 100 | to 100 | to 100 | to 100 |

TABLE 13

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Calcium lactate | 0.05 to 10 | 0.1 to 8.0 | 0.2 to 5.0 | 0.25 to 2.5 |
| Sorbitol | 1.0 to 10 | 2.0 to 8.0 | 2.0 to 8.0 | 3.0 to 6.0 |
| 4-formylphenylboronic acid | 0.001 to 2.0 | 0.01 to 1.5 | 0.01 to 1.5 | 0.01 to 1.0 |
| Phosphonate | 0.1 to 8.0 | 0.1 to 8.0 | 0.2 to 5.0 | 0.5 to 3.0 |
| Hydroxy mixed ethers | 0.5 to 10 | 1.0 to 8.0 | 1.0 to 8.0 | 2.0 to 6.0 |
| Water | 20 to 70 | 20 to 70 | 20 to 70 | 20 to 70 |
| misc. | to 100 | to 100 | to 100 | to 100 |

TABLE 10

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Ca ion source | 0.05 to 10 | 0.1 to 8.0 | 0.2 to 5.0 | 0.25 to 2.5 |
| Lactic acid (salt) | 0.05 to 10 | 0.1 to 8.0 | 0.2 to 5.0 | 0.25 to 2.5 |
| Phosphonate | 0.1 to 8.0 | 0.1 to 8.0 | 0.2 to 5.0 | 0.5 to 3.0 |
| Water | 20 to 70 | 20 to 70 | 20 to 70 | 20 to 70 |
| misc. | to 100 | to 100 | to 100 | to 100 |

TABLE 11

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Calcium lactate | 0.05 to 10 | 0.1 to 8.0 | 0.2 to 5.0 | 0.25 to 2.5 |
| 4-formyl-phenyl-boronic acid | 0.001 to 2.0 | 0.01 to 1.5 | 0.01 to 1.5 | 0.01 to 1.0 |
| Phosphonate | 0.1 to 8.0 | 0.1 to 8.0 | 0.2 to 5.0 | 0.5 to 3.0 |
| Water | 20 to 70 | 20 to 70 | 20 to 70 | 20 to 70 |
| misc. | to 100 | to 100 | to 100 | to 100 |

The cleaning agents according to the present invention preferably further contain builders. Included among the builders in this context are, in particular, the silicates, carbonates, organic co-builders, and—in cases where no environmental prejudices against their use exist—also the phosphates.

Among the plurality of commercially obtainable phosphates, the alkali metal phosphates have the greatest significance for the agents according to the present invention, with particular preference for pentasodium triphosphate, $Na_5P_3O_{10}$ (sodium tripolyphosphate) resp. pentapotassium triphosphate, $K_5P_3O_{10}$ (potassium tripolyphosphate).

If phosphates are used in the context of the present Application as substances having cleaning activity, preferred agents then contain that/those phosphate(s), by preference pentapotassium triphosphate, the weight proportion of the phosphate in terms of the total weight of the cleaning agent being by preference 5.0 and 40 wt %, preferably 10 and 30 wt %, and in particular 12 and 25 wt %.

Organic co-builders that may be recited are in particular polycarboxylates/polycarboxylic acids, polymeric polycarboxylates, aspartic acid, polyacetals, dextrins, further organic co-builders, as well as phosphonates. These substance classes are described below.

Usable organic builder substances are, for example, the polycarboxylic acids usable in the form of the free acid and/or sodium salts thereof, "polycarboxylic acids" being understood as those carboxylic acids that carry more than one acid function. These are, for example, citric acid, adipic acid, succinic acid, glutaric acid, malic acid, tartaric acid, maleic acid, fumaric acid, sugar acids, aminocarboxylic acids, nitrilotriacetic acid (NTA), provided such use is not objectionable for environmental reasons, as well as mixtures thereof. The free acids typically also possess, besides their builder effect, the property of an acidifying component, and thus also serve to establish a lower and milder pH for washing or cleaning agents. To be recited in this context are, in particular, citric acid, succinic acid, glutaric acid, adipic acid, gluconic acid, and any mixtures thereof.

Citric acid or salts of citric acid are used with particular preference as a builder substance.

A further particularly preferred builder substance is methylglycinediacetic acid (MGDA).

Also suitable as builders are polymeric polycarboxylates; these are, for example, the alkali metal salts of polyacrylic acid or of polymethacrylic acid, for example those having a relative molecular weight from 500 to 70,000 g/mol.

The molar masses indicated for polymeric polycarboxylates are, for purposes of this document, weight-average molar masses Mw of the respective acid form that were determined in principle by means of gel permeation chromatography (GPC), a UV detector having been used. The measurement was performed against an external polyacrylic acid standard that yields realistic molecular weight values because of its structural affinity with the polymers being investigated. These indications deviate considerably from the molecular weight indications in which polystyrenesulfonic acids are used as a standard. The molar weights measured against polystyrenesulfonic acids are usually much higher than the molar weights indicated in this document.

Suitable polymers are, in particular, polyacrylates that preferably have a molecular weight from 2000 to 20,000 g/mol. Of this group in turn, the short-chain polyacrylates, which have molar masses from 2000 to 10,000 g/mol and particularly preferably from 3000 to 5000 g/mol, may be preferred because of their superior solubility.

Also suitable are copolymeric polycarboxylates, in particular those of acrylic acid with methacrylic acid and of acrylic acid or methacrylic acid with maleic acid. Copolymers of acrylic acid with maleic acid that contain 50 to 90 wt % acrylic acid and 50 to 10 wt % maleic acid have proven particularly suitable. Their relative molecular weight, based on free acids, is equal to in general 2000 to 70,000 g/mol, by preference 20,000 to 50,000 g/mol, and in particular 30,000 to 40,000 g/mol.

Oxydisuccinates and other derivatives of disuccinates, by preference ethylenediamine disuccinate, are also additional suitable co-builders. Ethylenediamine-N,N'-disuccinate (EDDS) is used here, preferably in the form of its sodium or magnesium salts. Also preferred in this context are glycerol disuccinates and glycerol trisuccinates.

In order to improve cleaning performance and/or to adjust viscosity, preferred liquid cleaning agents contain at least one hydrophobically modified polymer, by preference a hydrophobically modified polymer containing carboxylic acid groups, the weight proportion of the hydrophobically modified polymer in terms of the total weight of the cleaning agent being by preference 0.1 to 10 wt %, preferably between 0.2 and 8.0 wt %, and in particular 0.4 to 6.0 wt %.

Supplementing the builders described above, polymers having cleaning activity can be contained in the cleaning agent. The weight proportion of the polymers having cleaning activity in terms of the total weight of automatic cleaning agents according to the present invention is by preference 0.1 to 20 wt %, by preference 1.0 to 15 wt %, and in particular 2.0 to 12 wt %.

Sulfonic acid group-containing polymers, in particular from the group of the copolymeric polysulfonates, are used by preference as polymers having cleaning activity. These copolymeric polysulfonates contain, besides sulfonic acid group-containing monomer(s), at least one monomer from the group of the unsaturated carboxylic acids.

Unsaturated carboxylic acids of the formula $R^1(R^2)C{=}C(R^3)COOH$ are used with particular preference as (an) unsaturated carboxylic acids(s), in which formula $R^1$ to $R^3$, mutually independently, denote —H, —$CH_3$, a straight-chain or branched saturated alkyl residue having 2 to 12 carbon atoms, a straight-chain or branched, mono- or polyunsaturated alkenyl residue having 2 to 12 carbon atoms, alkyl or alkenyl residues as defined above substituted with —$NH_2$, —OH, or —COOH, or denote —COOH or —$COOR^4$ where $R^4$ is a saturated or unsaturated, straight-chain or branched hydrocarbon residue having 1 to 12 carbon atoms.

Particularly preferred unsaturated carboxylic acids are acrylic acid, methacrylic acid, ethacrylic acid, ⟨-chloroacrylic acid, ⟨-cyanoacrylic acid, crotonic acid, ⟨-phenylacrylic acid, maleic acid, maleic acid anhydride, fumaric acid, itaconic acid, citraconic acid, methylenemalonic acid, sorbic acid, cinnamic acid, or mixtures thereof. The unsaturated dicarboxylic acids are of course also usable.

In the context of the sulfonic acid group-containing monomers, those of the formula $$R^5(R^6)C{=}C(R^7)—X—SO_3H,$$

in which $R^5$ to $R^7$, mutually independently, denote —H, —$CH_3$, a straight-chain or branched saturated alkyl residue having 2 to 12 carbon atoms, a straight-chain or branched, mono- or polyunsaturated alkenyl residue having 2 to 12 carbon atoms, alkyl or alkenyl residues substituted with —$NH_2$, —OH, or —COOH, or denote —COOH or —$COOR^4$, where $R^4$ is a saturated or unsaturated, straight-chain or branched hydrocarbon residue having 1 to 12 carbon atoms, and X denotes an optionally present spacer group that is selected from —$(CH_2)_n$— where n=0 to 4, —COO—$(CH_2)_k$— where k=1 to 6, —C(O)—NH—$C(CH_3)_2$—, —C(O)—NH—$C(CH_3)_2$—$CH_2$—, and —C(O)—NH—$CH(CH_2CH_3)$—, are preferred.

Among these monomers, those of the formulas $$H_2C{=}CH—X—SO_3H$$

$$H_2C{=}C(CH_3)—X—SO_3H$$

$$HO_3S—X—(R^6)C{=}C(R^7)—X—SO_3—H,$$

in which $R^6$ and $R^7$, mutually independently, are selected from —H, —$CH_3$, □$CH_2CH_3$, —$CH_2CH_2CH_3$, —$CH(CH_3)_2$, and X denotes an optionally present spacer group that is selected from —$(CH_2)_n$— where n=0 to 4, —COO—$(CH_2)_k$— where k=1 to 6, —C(O)—NH—$C(CH_3)_2$—, —C(O)—NH—$C(CH_3)_2$—$CH_2$—, and —C(O)—NH—$CH(CH_2CH_3)$—, are preferred.

Particularly preferred sulfonic acid group-containing monomers in this context are 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropylacrylate, 3-sulfopropylmethacrylate, sulfomethacrylamide, sulfomethylmethacrylamide, and mixtures of the aforesaid acids or water-soluble salts thereof.

The sulfonic acid groups can be present in the polymers entirely or partly in neutralized form. The use of partly or entirely neutralized sulfonic acid group-containing copolymers is preferred according to the present invention.

The molar mass of the sulfo-copolymers used in preferred fashion according to the present invention can be varied in order to adapt the properties of the polymers to the desired application. Preferred automatic dishwashing agents are characterized in that the copolymers have molar masses from 2000 to 200,000 $gmol^{-1}$, by preference from 4000 to 25,000 $gmol^{-1}$, and in particular from 5000 to 15,000 $gmol^{-1}$.

In a further preferred embodiment the copolymers also encompass, besides carboxyl group-containing monomers and sulfonic acid group-containing monomers, at least one nonionic, by preference hydrophobic monomer. The use of these hydrophobically modified polymers has made it possible to improve, in particular, the rinsing performance of automatic dishwashing agents according to the present invention.

Cleaning agents containing a copolymer encompassing i) carboxylic acid group-containing monomer(s), ii) sulfonic acid group-containing monomer(s), iii) nonionic monomer(s), are preferred according to the present invention. The use of these terpolymers has made it possible to improve the rinsing performance of automatic dishwashing agents according to the present invention with respect to comparable dishwashing agents that contain sulfopolymers without the addition of nonionic monomers.

The nonionic monomers used are by preference monomers of the general formula $R^1(R^2)C{=}C(R^3)—X—R^4$, in which $R^1$ to $R^3$, mutually independently, denote —H, $—CH_3$, or $—C_2H_5$, X denotes an optionally present spacer group that is selected from $—CH_2—$, —C(O)O—, and —C(O)—NH—, and $R^4$ denotes a straight-chain or branched saturated alkyl residue having 2 to 22 carbon atoms or an unsaturated, preferably aromatic residue having 6 to 22 carbon atoms.

Particularly preferred nonionic monomers are butene, isobutene, pentene, 3-methylbutene, 2-methylbutene, cyclopentene, hexene, hexene-1, 2-methlypentene-1, 3-methlypentene-1, cyclohexene, methylcyclopentene, cycloheptene, methylcyclohexene, 2,4,4-trimethylpentene-1, 2,4,4-trimethylpentene-2, 2,3-dimethylhexene-1,2,4-dimethylhexene-1, 2,5-dimethlyhexene-1, 3,5-dimethylhexene-1, 4,4-dimethylhexane-1, ethylcyclohexyne, 1-octene, ⟨-olefins having 10 or more carbon atoms such as, for example, 1-decene, 1-dodecene, 1-hexadecene, 1-octadecene, and C22-⟨-olefin, 2-styrene, ⟨-methylstyrene, 3-methylstyrene, 4-propylstryene, 4-cyclohexylstyrene, 4-dodecylstyrene, 2-ethyl-4-benzylstyrene, 1-vinylnaphthalene, 2-vinylnaphthalene, acrylic acid methyl ester, acrylic acid ethyl ester, acrylic acid propyl ester, acrylic acid butyl ester, acrylic acid pentyl ester, acrylic acid hexyl ester, methacrylic acid methyl ester, N-(methyl)acrylamide, acrylic acid 2-ethylhexyl ester, methacrylic acid 2-ethylhexyl ester, N-(2-ethylhexyl)acrylamide, acrylic acid octyl ester, methacrylic acid octyl ester, N-(octyl)acrylamide, acrylic acid lauryl ester, methacrylic acid lauryl ester, N-(lauryl)acrylamide, acrylic acid stearyl ester, methacrylic acid stearyl ester, N-(stearyl)acrylamide, acrylic acid behenyl ester, methacrylic acid behenyl ester, and N-(behenyl)acrylamide, or mixtures thereof.

The weight proportion of the sulfonic acid group-containing copolymers in terms of the total weight of cleaning agents according to the present invention is by preference 0.1 to 15 wt %, by preference 1.0 to 12 wt %, and in particular 2.0 to 10 wt %.

TABLE 14

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Calcium lactate | 0.05 to 10 | 0.1 to 8.0 | 0.2 to 5.0 | 0.25 to 2.5 |
| Sorbitol | 1.0 to 10 | 2.0 to 8.0 | 2.0 to 8.0 | 3.0 to 6.0 |
| 4-formylphenylboronic acid | 0.001 to 2.0 | 0.01 to 1.5 | 0.01 to 1.5 | 0.01 to 1.0 |
| Potassium tripolyphosphate | 5.0 to 40 | 10 to 30 | 12 to 25 | 12 to 25 |
| Phosphonate | 0.1 to 8.0 | 0.1 to 8.0 | 0.2 to 5.0 | 0.5 to 3.0 |
| Hydroxy mixed ethers | 0.5 to 10 | 1.0 to 8.0 | 1.0 to 8.0 | 2.0 to 6.0 |
| Water | 20 to 70 | 20 to 70 | 20 to 70 | 20 to 70 |
| misc. | to 100 | to 100 | to 100 | to 100 |

TABLE 15

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Calcium lactate | 0.05 to 10 | 0.1 to 8.0 | 0.2 to 5.0 | 0.25 to 2.5 |
| Sorbitol | 1.0 to 10 | 2.0 to 8.0 | 2.0 to 8.0 | 3.0 to 6.0 |
| 4-formylphenylboronic acid | 0.001 to 2.0 | 0.01 to 1.5 | 0.01 to 1.5 | 0.01 to 1.0 |
| Sulfonic acid-containing copolymer | 0.1 to 15 | 1.0 to 12 | 2.0 to 10 | 2.0 to 10 |
| Phosphonate | 0.1 to 8.0 | 0.1 to 8.0 | 0.2 to 5.0 | 0.5 to 3.0 |
| Hydroxy mixed ethers | 0.5 to 10 | 1.0 to 8.0 | 1.0 to 8.0 | 2.0 to 6.0 |
| Water | 20 to 70 | 20 to 70 | 20 to 70 | 20 to 70 |
| misc. | to 100 | to 100 | to 100 | to 100 |

TABLE 16

| | Formulation 1 | Formulation 2 | Formulation 3 | Formulation 4 |
|---|---|---|---|---|
| Amylase preparation | 0.001 to 5.0 | 0.01 to 4.0 | 0.05 to 3.0 | 0.075 to 2.0 |
| Calcium lactate | 0.05 to 10 | 0.1 to 8.0 | 0.2 to 5.0 | 0.25 to 2.5 |
| Sorbitol | 1.0 to 10 | 2.0 to 8.0 | 2.0 to 8.0 | 3.0 to 6.0 |
| 4-formylphenylboronic acid | 0.001 to 2.0 | 0.01 to 1.5 | 0.01 to 1.5 | 0.01 to 1.0 |
| Potassium tripolyphosphate | 5.0 to 40 | 10 to 30 | 12 to 25 | 12 to 25 |
| Sulfonic acid-containing copolymer | 0.1 to 15 | 1.0 to 12 | 2.0 to 10 | 2.0 to 10 |
| Phosphonate | 0.1 to 8.0 | 0.1 to 8.0 | 0.2 to 5.0 | 0.5 to 3.0 |
| Hydroxy mixed ethers | 0.5 to 10 | 1.0 to 8.0 | 1.0 to 8.0 | 2.0 to 6.0 |
| Water | 20 to 70 | 20 to 70 | 20 to 70 | 20 to 70 |
| misc. | to 100 | to 100 | to 100 | to 100 |

A further subject of the present Application is a method for automatic cleaning of tableware using an automatic dishwashing agent according to the present invention.

Dispensing of the cleaning agent according to the present invention into the cleaning bath can be accomplished, for example, by means of the dispensing chamber in the door or an additional dispensing container in the interior of the automatic dishwasher. Alternatively, the cleaning agent can also be applied directly onto the soiled tableware, or onto one of the inner walls of the automatic dishwasher, for example the inner side of the door.

The method according to the present invention is carried out in the interior of a commercially usual automatic dishwasher. The cleaning program of an automatic dishwasher can, as a rule, be selected and defined by the consumer before the dishwashing method is carried out. The cleaning program of the automatic dishwasher used in the method according to the present invention encompasses at least a pre-wash step and a cleaning step. Cleaning programs that encompass further cleaning or rinsing steps, for example a rinse aid step, are preferred according to the present invention.

The method according to the present invention is, with particular preference, a constituent of a cleaning program encompassing a pre-wash step, a cleaning step, and a rinse aid step. The cleaning programs of automatic dishwashers can differ in terms of their duration, their water consumption, and the temperature of the cleaning bath. The method according to the present invention is used preferably in conjunction with those cleaning programs in which the washing bath is heated in the course of the cleaning step.

In a preferred embodiment of the method according to the present invention, the cleaning step during which the cleaning agent according to the present invention is dispensed into the interior of the automatic dishwasher is characterized in that during it, the temperature of the cleaning bath rises to values above 30° C., by preference above 40° C., and in particular above 50° C.

Preferred embodiments of the automatic dishwashing method according to the present invention are evident, mutatis mutandis, from the description hitherto of preferred embodiments of the cleaning agent according to the present invention, to which reference is made at this juncture in order to avoid repetition.

As stated initially, the addition of calcium lactate is particularly suitable for stabilizing amylases in liquid cleaning agents. A further subject of this Application is therefore the use of calcium lactate to stabilize amylase in liquid cleaning agents, by preference in liquid cleaning agents having a water content of between 20 and 70 wt %.

Preferred embodiments of the use according to the present invention are evident, mutatis mutandis, from the description hitherto of preferred embodiments of the cleaning agent according to the present invention, to which reference is made at this juncture in order to avoid repetition.

It is particularly preferred, for example, to use the following active-substance combinations to stabilize amylases in liquid cleaning agents, by preference in liquid cleaning agents having a water content of between 20 and 70 wt %:

| | | | |
|---|---|---|---|
| Calcium lactate | 4-formylphenylboronic acid (4-FPBA) | — | — |
| Calcium lactate | 4-formylphenylboronic acid (4-FPBA) | Sorbitol | — |
| Calcium lactate | 4-formylphenylboronic acid (4-FPBA) | Sorbitol | Hydroxy mixed ethers |
| Calcium lactate | — | Sorbitol | — |
| Calcium lactate | — | Sorbitol | Hydroxy mixed ethers |
| Calcium lactate | — | — | Hydroxy mixed ethers |
| Calcium lactate | 4-formylphenylboronic acid (4-FPBA) | — | Hydroxy mixed ethers |

Examples

The following two cleaning-agent formulations V1 and E1 were supplied:

| | V1 (wt %) | E1 (wt %) |
|---|---|---|
| Potassium tripolyphosphate | 18.8 | 8.8 |
| Sodium carbonate | 5.0 | 5.0 |
| Sorbitol | 7.2 | 7.2 |
| Polycarboxylate[1)] | 2.5 | 0.4 |
| Polycarboxylate[2)] | 7.5 | 7.5 |
| KOH | 2.4 | 0.7 |
| Hydroxy mixed ethers | 2.0 | 2.0 |
| 1,2-Propylene glycol | 0.9 | 0.9 |
| Amylase preparation | 0.75 | 0.75 |
| Protease preparation | 0.9 | 0.9 |
| Phosphonate | 2.5 | 0.8 |
| Calcium lactate | — | 0.5 |
| Misc. (dye, scent, water, etc.) | to 100 | to 100 |

[1)]Hydrophobically modified polycarboxylate
[2)]Hydrophobically modified polysulfonate Cleaning performance was determined for both cleaning agents, V1 and E1, using the IKW method (Miele G 698 SC, 50° C., normal, 21° dH).

Cleaning performance was determined without storage and after four weeks of storage, for the following stains: tea, milk, ground meat, egg yolk, oatmeal, and starch (10=complete cleaning; 0=no cleaning).

| | V1 | E1 | V1 | E1 |
|---|---|---|---|---|
| | no storage | | after 4 weeks storage | |
| Tea | 3.7 | 3.6 | 3.2 | 3.2 |
| Egg yolk | 4.4 | 4.6 | 3.9 | 4.8 |
| Milk | 7.6 | 7.8 | 7.2 | 7.2 |
| Ground meat | 10.0 | 10.0 | 10.0 | 10.0 |
| Oatmeal | 7.7 | 8.0 | 0.2 | 7.2 |
| Starch | 9.1 | 9.5 | 0.0 | 7.9 |

As may be gathered from these experimental results, the cleaning agent stabilized by the addition of calcium lactate exhibits considerably better cleaning results on the stains relevant to amylase, in particular after storage, than the calcium lactate-free cleaning agent.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A liquid cleaning agent comprising:

a) 20 to 70 wt % water;

b) at least one amylase preparation;

c) a $Ca^{2+}$-ion source;

d) lactic acid or a lactic acid salt;

wherein, calcium lactate is the source of $Ca^{2+}$ and lactic acid present in the agent, and wherein, based on the total weight of the cleaning agent, the liquid cleaning agent comprises from 0.25 to 2.5% calcium lactate, and the cleaning agent further comprises copolymeric polysulfonates from 0.1 to 20 wt % and wherein the agent further comprises from 0.5 to 10 wt % of hydroxyl mixed ether of the general formula $R^1$—CH(OH) $CH_2O$-$(AO)_w$-$(A'O)_x$-$(A''O)_y$-$(A'''O)_z$—$R^2$ in which: $R^1$ denotes a straight-chain or branched, saturated or mono- or polyunsaturated $C_{6-24}$ alkyl or alkenyl residue; $R^2$ denotes a linear or branched hydrocarbon residue having 2 to 26 carbon atoms; A, A', A'', and A''', mutually independently, denote a residue from the group —$CH_2CH_2$, —$CH_2CH_2$—$CH_2$, —$CH_2$—CH($CH_3$), —$CH_2$—$CH_2$—$CH_2$—$CH_2$, —$CH_2$—CH($CH_3$)—$CH_2$—, —$CH_2$—CH($CH_2$—$CH_3$), w, x, y, and z denote values between 0.5 and 120, such that x, y, and/or z can also be 0.

2. The liquid cleaning agent according to claim 1, wherein the weight proportion of the active protein of the amylase preparation in terms of the total weight of the cleaning agent is between 0.001 and 5.0 wt %.

3. The liquid cleaning agent according to claim 1, wherein the cleaning agent further comprises a phenylboronic acid derivative having the structural formula

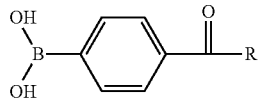

in which R denotes hydrogen, a hydroxyl, a $C_1$ to $C_6$ alkyl, a substituted $C_1$ to $C_6$ alkyl, a $C_1$ to $C_6$ alkenyl, or a substituted $C_1$ to $C_6$ alkenyl group, wherein the weight proportion of the phenylboronic acid derivative in terms of the total weight of the cleaning agent is from 0.001 to 2 wt %.

4. The liquid cleaning agent according to claim 1, wherein the cleaning agent further comprises at least one alditol, and wherein the weight proportion of the alditol in terms of the total weight of the cleaning agent is from 1.0 to 10 wt %.

5. The liquid cleaning agent according to claim 1, wherein the cleaning agent further comprises at least one complexing agent from the group of the phosphonates, and wherein the weight proportion of the phosphonate in terms of the total weight of the cleaning agent is from 0.1 to 8.0 wt %.

6. A method for automatic cleaning of tableware using an automatic dishwashing agent according to claim 1.

* * * * *